US011084076B2

(12) United States Patent
Chen et al.

(10) Patent No.: US 11,084,076 B2
(45) Date of Patent: Aug. 10, 2021

(54) COOLING OF A METAL STRIP USING A POSITION-CONTROLLED VALVE DEVICE

(71) Applicant: PRIMETALS TECHNOLOGIES AUSTRIA GMBH, Linz (AT)

(72) Inventors: Jian Chen, St. Marien (AT); Sieglinde Ehgartner, Linz (AT); Reinhard Karl, Klosterneuburg (AT); Erich Opitz, Moenchhof (AT); Florian Poeschl, Linz (AT); Alois Seilinger, Linz (AT); Thomas Trickl, Koppl (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 0 days.

(21) Appl. No.: 16/893,020

(22) Filed: Jun. 4, 2020

(65) Prior Publication Data

US 2020/0298295 A1 Sep. 24, 2020

Related U.S. Application Data

(62) Division of application No. 14/768,076, filed as application No. PCT/EP2014/052385 on Feb. 7, 2014, now Pat. No. 10,722,929.

(30) Foreign Application Priority Data

Feb. 14, 2013 (EP) ..... 13155151

(51) Int. Cl.
*B21B 45/02* (2006.01)
*C21D 1/667* (2006.01)

(52) U.S. Cl.
CPC ..... *B21B 45/0218* (2013.01); *C21D 1/667* (2013.01)

(58) Field of Classification Search
CPC ..... B21B 45/0218; C21D 1/667
(Continued)

(56) References Cited

U.S. PATENT DOCUMENTS 3,589,160 A 6/1971 Gruver et al.
4,232,853 A * 11/1980 Bando ..... B05B 7/0416 266/114
(Continued)

FOREIGN PATENT DOCUMENTS

CN 101616755 12/2009
CN 101952059 1/2011
(Continued)

OTHER PUBLICATIONS

Search Report dated May 9, 2014 issued in corresponding PCT application PCT/EP2014/052385.
(Continued)

*Primary Examiner* — Jessee R Roe
*Assistant Examiner* — Michael Aboagye
(74) *Attorney, Agent, or Firm* — Ostrolenk Faber LLP

(57) ABSTRACT

A handling line that includes a valve in a feed line that sets the valve to a respective opening position (s) for adjusting a coolant flow (F) to a metal strip per unit of time; an upstream condition detection device upstream of the valve device in the feed line that detects an upstream condition (ZV) of the coolant; a control unit that determines a set point (s*) for an opening position (s) of the valve device corresponding to the set point (F*) for the coolant flow (F) based on a set point (F*) for the coolant flow (F*), the upstream condition (ZV) of the coolant and a valve characteristic (C) of the valve device.

17 Claims, 2 Drawing Sheets

(58) Field of Classification Search
USPC ..... 148/508; 266/44, 46, 78, 259, 113, 114
See application file for complete search history.

(56) References Cited

U.S. PATENT DOCUMENTS

| | | | | |
|---|---|---|---|---|
| 8,318,080 | B2 * | 11/2012 | Ueoka | B21B 45/0218 266/44 |
| 8,412,253 | B2 | 4/2013 | Holm et al. | |
| 8,463,446 | B2 | 6/2013 | Borgmann et al. | |
| 9,358,597 | B2 * | 6/2016 | Beeston | B21B 45/0233 |
| 10,076,778 | B2 * | 9/2018 | Chen | B21B 45/0215 |
| 2008/0314367 | A1 | 12/2008 | Goulette et al. | |
| 2011/0107776 | A1 * | 5/2011 | Mallison | H04W 72/10 62/103 |
| 2011/0266725 | A1 * | 11/2011 | Mehrain | C21D 9/46 266/44 |

FOREIGN PATENT DOCUMENTS

| | | |
|---|---|---|
| CN | 101983108 | 3/2011 |
| CN | 102834193 | 12/2012 |
| DE | 213 853 | 9/1984 |
| DE | 10 2007 046279 | 4/2009 |
| EP | 2 108 465 | 10/2009 |
| EP | 2 540 407 | 1/2013 |

OTHER PUBLICATIONS

Written Opinion dated May 9, 2014 issued in corresponding PCT application PCT/EP2014/052385.
Office Action dated Mar. 24, 2016 in corresponding Chinese Application No. 201480009061.2.
Examination Report dated Mar. 7, 2019 issued in corresponding Indian Application No. 6633/DELNP/2015 with English translation.

* cited by examiner

COOLING OF A METAL STRIP USING A POSITION-CONTROLLED VALVE DEVICE

CROSS-REFERENCE TO RELATED APPLICATIONS

The present application is a divisional of U.S. patent application Ser. No. 14/768,076, filed Aug. 14, 2015, issued as U.S. Pat. No. 10,722,929, which is a 35 U.S.C. §§ 371 national phase conversion of PCT/EP2014/052385, filed Feb. 7, 2014, which claims priority of European Patent Application No. 13155151.7, filed Feb. 14, 2013, the contents of which are incorporated by reference herein. The PCT International Application was published in the German language.

BACKGROUND OF THE INVENTION

The present invention relates to an operating method for a cooling device for cooling a metal strip by means of a liquid coolant, wherein the cooling device has an application device, by means of which coolant is applied to the metal strip, wherein the coolant is fed to the application device by a feed line, wherein a valve device is arranged in the feed line, wherein an upstream condition detection device is arranged upstream of the valve device in the feed line and is used to detect an upstream condition of the coolant that the coolant has in the feed line upstream of the valve device, wherein a control device sets the valve device.

The present invention also relates to a computer program which comprises machine code that can be executed directly by a control device for a cooling device for cooling a metal strip by means of a liquid coolant, wherein the execution of the machine code by the control device has the effect that the control device determines on the basis of a setpoint value for a coolant flow of the liquid coolant that is to be applied per unit of time to the metal strip by means of an application device, an upstream condition of the coolant that the coolant in a feed line for the liquid coolant has upstream of a valve device arranged in the feed line, and a valve characteristic of the valve device a setpoint activation of the valve device, and correspondingly activates the valve device, wherein the liquid coolant of the application device is fed by the feed line.

The present invention also relates to a control device for a cooling device for cooling a metal strip by means of a liquid coolant, wherein the control device is formed as a software-programmable control device and is programmed with such a computer program.

The present invention also relates to a cooling device for cooling a metal strip by means of a liquid coolant, wherein the cooling device has an application device, which applies the coolant to the metal strip, wherein the coolant is fed to the application device by a feed line, wherein a valve device is arranged in the feed line, wherein a coolant flow that is applied per unit of time to the metal strip by the application device is set by setting the valve device, wherein an upstream condition detection device is arranged upstream of the valve device in the feed line and is used to detect an upstream condition of the coolant that the coolant has in the feed line upstream of the valve device, wherein the cooling device has such a control device.

The aforementioned subjects are known for example from DE 10 2007 046 279 A1. In the case of DE 10 2007 046 279 A1, the valve device is formed as a switching valve, which is switched in a binary manner between the states of fully open and fully closed. The valve characteristic comprises a switching-on delay, a switching-off delay and an average coolant flow rate.

DD 213 853 discloses an operating method for a cooling device for cooling a metal strip by a liquid coolant, wherein the coupling device has an application device which applies coolant to the metal strip. The coolant is fed to the cooling device by a feed line. A valve device is arranged in the feed line. By setting the valve device to a respective open position, a coolant flow that is applied per unit of time to the metal strip by the application device can be set in a number of steps. A flowmeter is arranged upstream of the valve device in the feed line and is used to detect the flow through the valve device. A control device of the cooling device compares the detected actual value of the coolant flow with a setpoint value for the coolant flow. In a way corresponding to the deviation, the opening position of the valve device is corrected in steps.

Power cooling—that is to say the intensive cooling of metal strip—is a novel cooling method for cooling a metal strip during hot rolling or directly thereafter. It serves the purpose of specifically setting the microstructure, and consequently the mechanical properties of the end product. In particular, steels known as AHSS (=advanced high-strength steels) require ever greater cooling intensity and cooling flexibility. These requirements are met by power cooling.

In the course of power cooling it is necessary to set the coolant flow, i.e. the amount of coolant that is applied per unit of time to the metal strip, precisely, reproducibly and dynamically. In the prior art, this is done by a flowmeter arranged in the feed line to the application device and the flow is controlled by means of the valve device. However, this procedure has several disadvantages. In particular, an overshooting often takes place in practice when setting a new setpoint value. A settling phase, up to when the new setpoint value is steadily maintained, is often relatively long. Furthermore, flowmeters are relatively expensive.

SUMMARY OF THE INVENTION

The object of the present invention is to provide possibilities which can achieve flexible and reliable cooling of the metal strip in a simple and low-cost way.

According to the invention, an operating method of the type mentioned at the beginning is devised in such a way that, by setting the valve device to a respective opening position steplessly or in a number of steps, a coolant flow that is applied per unit of time to the metal strip by the application device can be set, that a control device of the cooling device determines on the basis of a setpoint value for the coolant flow, the upstream condition of the coolant and a valve characteristic of the valve device a setpoint value for an opening position of the valve device that corresponds to the setpoint value for the coolant flow, that, with respect to a reference condition that the coolant has in the feed line upstream of the valve device, the valve characteristic describes a characteristic line of the coolant flow as a function of the opening position of the valve device and that the control device sets the opening position of the valve device in a way corresponding to the setpoint value determined.

The upstream condition of the coolant can be determined as and when required. For example, the upstream condition of the coolant may comprise its temperature and/or its chemical composition. Preferably, the upstream condition of the coolant comprises (at least) an upstream feed-line pressure that is applied to the coolant in the feed line upstream of the valve device.

In a particularly preferred refinement of the operating method, it is provided that a downstream condition detection device is arranged in the feed line between the valve device and the application device or in the application device and is used to detect a downstream condition of the coolant that the coolant has in the feed line between the valve device and the application device or in the application device, and that the control device corrects the characteristic line of the valve device on the basis of the upstream condition of the coolant, the downstream condition of the coolant and the opening position of the valve device.

In this way, a self-calibration of the control device to the actual and under some circumstances even dynamically varying, characteristic line of the valve device can be realized.

The downstream condition of the coolant may, by analogy with the upstream condition of the coolant, be determined as and when required. Preferably, the downstream condition of the coolant comprises (at least) a downstream feed-line pressure that is applied to the coolant in the feed line between the valve device and the application device or in the application device.

The present invention can also be applied in principle to normal cooling devices, in which an upstream feed-line pressure that the coolant has in the feed line upstream of the valve device is relatively low. Preferably, however, the upstream feed-line pressure lies between 1.5 bar and 5.0 bar, in particular between 2.0 bar and 3.0 bar.

According to the invention, a computer program of the type mentioned at the beginning is designed in such a way that the control device determines a setpoint value for an opening position of the valve device that corresponds to the setpoint value for the coolant flow and sets the opening position of the valve device in a way corresponding to the setpoint value determined, that, by setting the valve device to a respective opening position steplessly or in a number of steps, the coolant flow can be set and that, with respect to a reference condition that the coolant has in the feed line upstream of the valve device, the valve characteristic describes a characteristic line of the coolant flow as a function of the opening position of the valve device.

The advantageous refinements of the computer program correspond substantially to those of the operating method.

Therefore, to avoid repetition, reference is made to the statements given above.

According to the invention, a control device is programmed with a computer program according to the invention.

According to the invention, the control device is formed or programmed according to the invention.

The properties, features and advantages of this invention that are described above and also the manner in which they are achieved become clearer and more easily understandable in connection with the following description of the exemplary embodiments, which are explained more specifically in conjunction with the schematically represented drawings, in which:

DESCRIPTION OF AN EMBODIMENT

Figure 1:
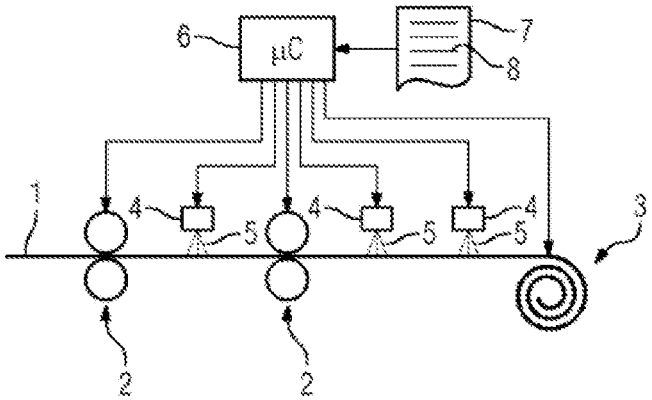
FIG. 1 shows a handling line for a metal strip.

According to FIG. 1, a handling line for a metal strip 1 has at least one rolling stand 2—usually a number of rolling stands 2 in tandem arrangement—and a coiling device 3. In the rolling stands 2, the metal strip 1 is rolled. Then, the metal strip 1 is coiled by the coiling device 3. Between the rolling stands 2 and/or between the last rolling stand 2 and the coiling device 3, cooling devices 4 may be arranged. The cooling devices 4 cool the metal strip 1 with a liquid coolant 5. The liquid coolant 5 is generally water, or at least contains water as a main constituent.

The handling line is controlled by a control device 6. The control device 6 may comprise a number of subunits, which respectively control part of the handling line. The present invention depends on the control device 6 to control at least one of the cooling devices 4. Therefore, just one of the cooling devices 4 is discussed below in conjunction with FIGS. 2 and 3—as representative of all the cooling devices 4.

As indicated by the abbreviation "μC", the control device 6 is formed as a software-programmable control device. It is programmed with a computer program 7 stored on a machine readable, non-transitory storage medium of a computer program product. The computer program 7 comprises machine code 8, which can be executed directly by the control device 6. The processing of the machine code 8 by the control device 6 brings about the internal functionality of the control device 6, which is explained more specifically below in conjunction with the overall functioning mode of the cooling device 4 considered.

Figure 2:
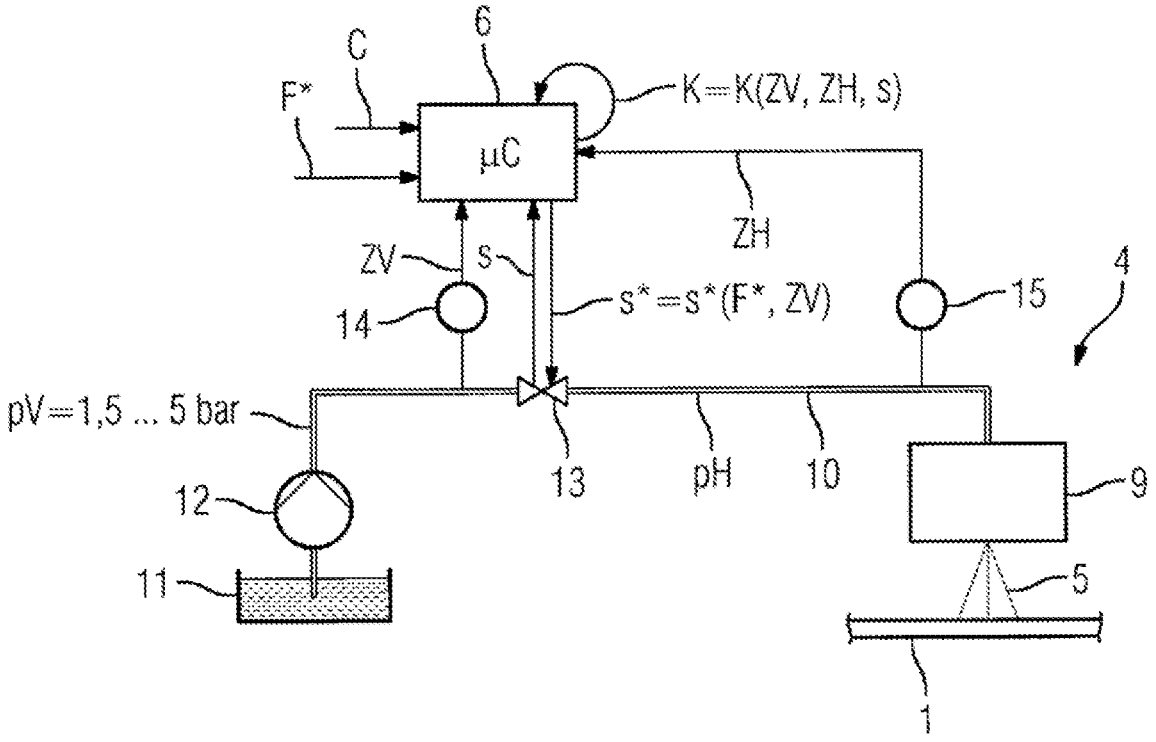
FIG. 2 shows a cooling device.

According to FIG. 2, the cooling device 4 has an application device 9. The application device 9 is used to apply the coolant 5 to the metal strip 1. The application device 9 may for example be formed as an upper spray bar, by means of which the coolant 5 is applied to the metal strip 1 from above. Alternatively, the application device 9 may for example be formed as a lower spray bar, by means of which the coolant 5 is applied to the metal strip 1 from below. Other refinements are also possible.

The coolant 5 is fed to the application device 9 by a feed line 10 from a reservoir 11. A pump 12 is arranged in the feed line 10. The pump 12 applies the coolant 5 is applied with a pressure pV, hereinafter referred to as the upstream feed-line pressure pV. A valve device 13 is also arranged in the feed line 10. between the pump 12 and the application device 9.

The valve device 13 is formed as a servo valve. By appropriate setting of the valve device 13 to a respective opening position s, therefore—see FIG. 3—a coolant flow F that is applied per unit of time to the metal strip 1 by the application device 9 can be set. It is possible that the opening position s, and consequently also the coolant flow F, can be set steplessly between 0 and a maximum flow, in a way corresponding to the solid line in FIG. 3. Alternatively, it is possible that the opening position s, and consequently also the coolant flow F, can be set in a number of steps, in a way corresponding to the small dots in FIG. 3. The number of steps is in this case at least three. For example, it may be 7 ($=2^3-1$), 15 ($=2^4-1$) or generally $2^n-1$ (n=5, 6, . . . ). In any event, the coolant flow F can be set by the valve device 13 to a number of values other than 0.

Figure 3:
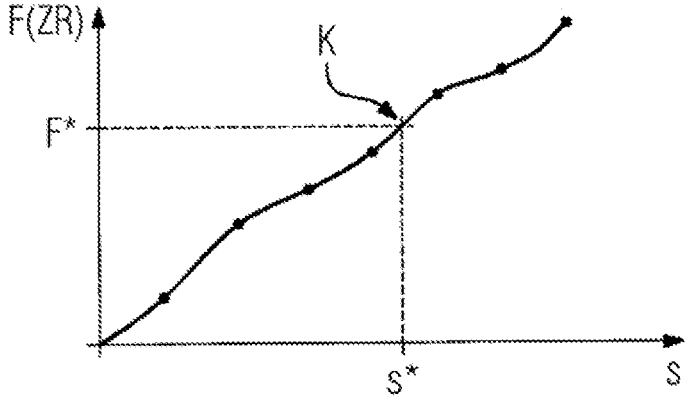
FIG. 3 shows a valve characteristic.

The dependence of the coolant flow F on the opening position s that is represented in FIG. 3, as an example, corresponds to a characteristic line K of the coolant flow F as a function of the opening position s of the valve device 13. The characteristic line K only applies whenever the coolant 5 has the reference condition ZR in the feed line 10 upstream of the valve device 13. The reference condition ZR preferably comprises at least one reference pressure that is applied to the coolant 5 in the feed line 10 upstream of the valve device 13.

The characteristic line K represents within the scope of the present invention the relevant part of a valve characteristic C of the valve device 13. If appropriate, the valve characteristic C may additionally comprise further parameters of the valve device 13. Examples of such parameters are delay times that may occur when changing the opening position s (step-response). However, this is of secondary importance within the scope of the present invention.

In the feed line 10, an upstream condition detection device 14 is arranged upstream of the valve device 13. The upstream condition detection device 14 is operable to detect an upstream condition ZV of the coolant 5 that the coolant 5 actually has in the feed line 10 upstream of the valve device 13. The upstream condition ZV preferably comprises at least the upstream feed-line pressure pV that is (actually) applied to the coolant 5 in the feed line 10 upstream of the valve device 13.

According to FIG. 2, the control device 6 is fed a setpoint value F* for the coolant flow F and the upstream condition ZV. Furthermore, the valve characteristic C of the valve device 13 is also known to the control device 6. The control device 6 is therefore capable of determining on the basis of the setpoint value F* for the coolant flow F, the upstream condition ZV of the coolant 5 and the valve characteristic C of the valve device 13, in particular the characteristic line K, a setpoint value s* for the opening position s of the valve device 13. The determined setpoint value s* for the opening position s of the valve device 13 corresponds to the predetermined setpoint value F* for the coolant flow F. The control device 6 sets the opening position s of the valve device 13 in a way corresponding to the determined setpoint value s*. The control device 6 can alternatively set the valve device 13 in an open-loop or closed-loop controlled manner.

In a preferred refinement of the present invention, according to FIG. 2, a downstream condition detection device 15 is arranged in the feed line 10 between the valve device 13 and the application device 9. The downstream condition detection device 15 detects a downstream condition ZH of the coolant 5 that the coolant 5 has in the feed line 10 between the valve device 13 and the application device 9. Alternatively, the downstream condition detection device 15 may be arranged in the application device 9 itself. In this case, the downstream condition detection device 15 detects a downstream condition ZH of the coolant 5 that the coolant 5 has in the application device 9 itself. The downstream condition ZH is likewise fed to the control device 6. The control device 6 is therefore capable of correcting the characteristic line K of the valve device 13 on the basis of the upstream condition ZV of the coolant 5, the downstream condition ZH of the coolant 5 and the opening position s of the valve device 13. The downstream condition ZH may in particular—by analogy with the upstream condition ZV—comprise a downstream feed-line pressure pH that is applied to the coolant 5 in the feed line 10 between the valve device 13 and the application device 9 or in the application device 9 itself.

For correcting the characteristic line K, the characteristic line K is preferably parameterized. For example, interpolation points for which the associated coolant flow F is predefined may be predetermined. In this case, an interpolation takes place between the interpolation points. If a deviation of the downstream condition ZH from an expected downstream condition occurs for an opening position s of the valve device 13 that lies between two interpolation points, the coolant flows F defined for the two interpolation points may for example be corrected in a weighted manner in a way corresponding to the distances of the opening position s from the two interpolation points. The weighting is in this case all the greater the smaller the distance of the opening position s from the respective interpolation point.

It is possible that the upstream feed-line pressure pV that the coolant 5 has in the feed line 10 upstream of the valve device 13 is relatively low, for example lies at about 0.2 bar to 0.3 bar. Preferably, however, the upstream feed-line pressure pV lies between 1.5 bar and 5.0 bar. In particular, it may lie between 2.0 bar and 3.0 bar.

The present invention has many advantages. In particular, the coolant flow F can be set precisely and reproducibly in an easy and low-cost way, while overshooting can be avoided.

Although the invention has been illustrated more specifically and discussed in detail by the preferred exemplary embodiment, the invention is not restricted by the examples disclosed and other variations may be derived therefrom by a person skilled in the art without departing from the scope of protection of the invention.

LIST OF DESIGNATIONS

1 Metal strip
2 Rolling stands
3 Coiling device
4 Cooling devices
5 Coolant
6 Control device
7 Computer program
8 Machine code
9 Application device
10 Feed line
11 Reservoir
12 Pumps
13 Valve device
14 Upstream condition detection device
15 Downstream condition detection device
C Valve characteristic
F Coolant flow
F* Setpoint value for the coolant flow
K Characteristic line
pH Downstream feed-line pressure
pV Upstream feed-like pressure
s Opening position
s* Setpoint value for the opening position
ZH Downstream condition
ZR Reference condition
ZV Upstream condition

What is claimed is:

1. A handling line having a cooling device for cooling a metal strip with a liquid coolant, comprising:

an application device configured for applying coolant to the metal strip;

a feed line for the coolant;

a valve device arranged in the feed line for the coolant, the valve device having a plurality of open positions, and the valve device exhibiting a characteristic coolant flow (K): 1) at a given pressure that is applied to the coolant in the feed line upstream of the valve device, and 2) at an open position from among the plurality of open positions, the characteristic coolant flow having a unique value at the given pressure that is applied to the coolant in the feedline upstream of the valve device and the open position from among the plurality of open positions;

a pressure detection device that detects an upstream condition (ZV) of the coolant in the feed line upstream of the valve device, the upstream condition (ZV) being an upstream feed-line pressure (pV) applied to the coolant in the feed line upstream of the valve device; and a control device that 1) receives a set point value (F*) for a desired coolant flow (F) to flow out of the valve device that is applied per unit of time to the metal strip by the application device, 2) is configured to determine a setpoint value (s*) for the open position from among the plurality of open positions of the valve device that would result in the desired coolant flow from the valve device, based on the set point valve (F*) for the desired coolant flow (F) to flow out of the valve device, and the characteristic coolant flow (K) of the valve device at the detected upstream condition (ZV) of the coolant, and 3) sets the open position of the valve to an open position from among the plurality of open positions that corresponds to the determined setpoint value (s*).

2. The handling line of claim 1, further comprising a detector that detects a downstream condition (ZH) of the coolant in the feed line downstream of the valve device, wherein the control device is configured to correct the characteristic line (K) of the valve device based on the upstream condition (ZV) of the coolant, the downstream condition (ZH) of the coolant and the open position of the valve device.

3. The handling line of claim 2, wherein the detector that detects the downstream condition is located between the valve device and the application device.

4. The handling line of claim 2, wherein the detector that detects the downstream condition is in the application device.

5. The handling line of claim 2, wherein the downstream condition (ZH) of the coolant comprises a downstream feed-line pressure (pH) that is applied to the coolant downstream of the valve device.

6. The handling line of claim 5, wherein the downstream feed-line pressure (pH) is detected in the feed line between the valve device and the application device.

7. The handling line of claim 5, wherein the downstream feed-line pressure (pH) is detected in the application device.

8. The handling line of claim 1, wherein the application device is an upper spray bar.

9. The handling line of claim 1, wherein the application device is a lower spray bar.

10. The handling line of claim 1, further comprising a reservoir connected to the feed line and a pump in the feed line upstream of the valve device.

11. The handling line of claim 1, wherein the valve device is a servo valve.

12. The handling line of claim 1, further comprising a rolling stand for rolling the metal strip located upstream or downstream of the cooling device.

13. The handling line of claim 1, further comprising a coiling device downstream of the cooling device.

14. The handling line of claim 1, further comprising a detector that detects a downstream condition (ZH) of the coolant in the feed line downstream of the valve device, wherein the control device is configured to parameterize the characteristic line (K) to correct the characteristic line (K) of the valve device based on the upstream condition (ZV) of the coolant, the downstream condition (ZH) of the coolant and the open position of the valve device.

15. The handling line of claim 14, wherein the control device corrects the characteristic line (K) by predetermining interpolation points for which the associated coolant flow (F) is predefined, interpolating between the interpolation points, and correcting the coolant flow between the interpolation points when a deviation of the downstream condition (ZH) from an expected downstream condition occurs for a set open position of the valve device.

16. The handling line of claim 15, wherein the coolant flows (F) defined for two interpolation points is corrected in a weighted manner that corresponds to distances of the set open position from the two interpolation points.

17. The handling line of claim 16, wherein the weighting is greater when the distance of the set open position from the respective interpolation point is smaller.

* * * * *